US007106991B2

(12) United States Patent
Hosokawa et al.

(10) Patent No.: US 7,106,991 B2
(45) Date of Patent: Sep. 12, 2006

(54) PROCESS CARTRIDGE SMOOTHLY AND STABLY ATTACHED TO AND DETACHED FROM AN IMAGE FORMING APPARATUS, AND AN IMAGE FORMING APPARATUS INCLUDING THE PROCESS CARTRIDGE

(75) Inventors: Hiroshi Hosokawa, Kanagawa-ken (JP); Tetsuroh Miura, Tokyo (JP); Shinichi Kawahara, Tokyo (JP); Takaaki Tawada, Kanagawa-ken (JP); Yoshiyuki Kimura, Tokyo (JP); Hideki Zemba, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 129 days.

(21) Appl. No.: 10/786,120

(22) Filed: Feb. 26, 2004

(65) Prior Publication Data

US 2004/0223782 A1 Nov. 11, 2004

(30) Foreign Application Priority Data

Feb. 28, 2003 (JP) ..... 2003-054098
Jan. 16, 2004 (JP) ..... 2004-009527

(51) Int. Cl.
*G03G 21/16* (2006.01)

(52) U.S. Cl. ..... 399/111; 399/107; 399/116

(58) Field of Classification Search ..... 399/111
See application file for complete search history.

(56) References Cited

U.S. PATENT DOCUMENTS 4,875,063 A 10/1989 Idenawa et al.
5,227,842 A 7/1993 Hayashi et al.
5,265,855 A 11/1993 Kimura et al.
5,270,783 A 12/1993 Bisaiji et al.
5,321,466 A 6/1994 Kimura et al.
5,482,265 A 1/1996 Nakazato et al.
5,486,909 A 1/1996 Takenaka et al.
5,489,747 A 2/1996 Takenaka et al.
5,493,365 A 2/1996 Matsui et al.
5,547,793 A 8/1996 Kuramoto et al.
5,552,870 A 9/1996 Murakami et al.
5,572,293 A 11/1996 Kikuchi et al.

(Continued)

FOREIGN PATENT DOCUMENTS

JP 2002-14596 1/2002

(Continued)

OTHER PUBLICATIONS

U.S. Appl. No. 10/786,120, filed Feb. 26, 2004, Hosokawa et al.

(Continued)

*Primary Examiner*—David M. Gray
*Assistant Examiner*—Ryan D. Walsh
(74) *Attorney, Agent, or Firm*—Oblon, Spivak, McClelland, Maier & Neustadt, P.C.

(57) ABSTRACT

A process cartridge detachably attached to an image forming apparatus includes an image carrier, at least one image forming process device, a case that integrally accommodates the image carrier and the at least one image forming process device, and a first non-slip holding portion provided on a partial surface of the case. The process cartridge is configured to move in a direction substantially parallel to a longitudinal direction of the image carrier. When the process cartridge is attached to and detached from the image forming apparatus, an operator of the image forming apparatus holds the process cartridge by grasping the first non-slip holding portion and a rear surface of a part of the case located on a side opposite from the first non-slip holding portion.

20 Claims, 6 Drawing Sheets

U.S. PATENT DOCUMENTS 5,574,538 A 11/1996 Takahashi et al.
5,596,395 A 1/1997 Sawamura et al.
5,605,777 A 2/1997 Ando et al.
5,610,691 A 3/1997 Takahashi et al.
5,610,693 A 3/1997 Sugiyama et al.
5,617,191 A 4/1997 Murakami et al.
5,625,438 A 4/1997 Sugiyama et al.
5,625,440 A 4/1997 Matsumae et al.
5,625,441 A 4/1997 Sugiyama et al.
5,627,630 A 5/1997 Matsumae et al.
5,640,645 A 6/1997 Namekata et al.
5,666,625 A 9/1997 Komatsubara et al.
5,689,782 A 11/1997 Murakami et al.
5,697,026 A 12/1997 Matsumae et al.
5,708,942 A 1/1998 Sugiyama et al.
5,753,400 A 5/1998 Kuramoto et al.
5,768,665 A 6/1998 Yamanaka et al.
5,784,669 A 7/1998 Miura et al.
5,819,145 A 10/1998 Tanaka et al.
5,826,144 A 10/1998 Takenaka et al.
5,845,183 A 12/1998 Sugiyama et al.
5,879,752 A 3/1999 Murakami et al.
5,909,609 A 6/1999 Yahata et al.
5,918,087 A 6/1999 Kimura et al.
5,923,936 A 7/1999 Tanoue et al.
5,930,561 A 7/1999 Hosokawa et al.
5,943,529 A * 8/1999 Miyabe et al. ..... 399/111
5,950,062 A 9/1999 Yahata et al.
5,991,569 A 11/1999 Sugihara et al.
6,033,818 A 3/2000 Sugiyama et al.
6,047,758 A 4/2000 Kuramoto et al.
6,070,037 A 5/2000 Sugihara et al.
6,072,967 A 6/2000 Sugihara et al.
6,085,062 A 7/2000 Mizuishi et al.
6,095,164 A 8/2000 Saitoh et al.
6,104,900 A 8/2000 Ishikawa et al.
6,122,469 A 9/2000 Miura et al.
6,128,449 A 10/2000 Zenba et al.
RE36,963 E 11/2000 Ando et al.
6,144,811 A 11/2000 Ohori et al.
6,144,822 A 11/2000 Yamaguchi et al.
6,148,161 A 11/2000 Usui et al.
6,160,969 A 12/2000 Ishigaki et al.
6,163,666 A 12/2000 Hosokawa et al.
6,212,343 B1 4/2001 Hosokawa et al.
6,249,661 B1 6/2001 Saitoh et al.
6,266,501 B1 7/2001 Mizuishi et al.
6,336,020 B1 1/2002 Ishikawa et al.
6,337,957 B1 1/2002 Tamaki et al.
RE37,645 E 4/2002 Takahashi et al.
6,408,142 B1 * 6/2002 Takeuchi et al. ..... 399/13
6,522,855 B1 2/2003 Katoh et al.
6,560,431 B1 5/2003 Hosokawa et al.
6,628,903 B1 9/2003 Ohori et al.
6,690,905 B1 2/2004 Takahashi et al.
6,836,629 B1 * 12/2004 Miyabe et al. ..... 399/111
2002/0135655 A1 9/2002 Ameyama et al.

FOREIGN PATENT DOCUMENTS

JP 2002-196647 7/2002
JP 2002-297002 10/2002

OTHER PUBLICATIONS

U.S. Appl. No. 11/019,424, filed Dec. 23, 2004, Hosokawa et al.
U.S. Appl. No. 11/100,813, filed Apr. 7, 2005, Ojimi et al.
U.S. Appl. No. 11/206,812, Aug. 19, 2005, Tawada.
U.S. Appl. No. 11/226,197, filed Sep. 15, 2005, Kimura et al.
U.S. Appl. No. 11/182.863, filed Jul. 18, 2005, Hosokawa et al.
U.S. Appl. No. 11/287,305, filed Nov. 28, 2005, Hosokawa et al.

* cited by examiner

PROCESS CARTRIDGE SMOOTHLY AND STABLY ATTACHED TO AND DETACHED FROM AN IMAGE FORMING APPARATUS, AND AN IMAGE FORMING APPARATUS INCLUDING THE PROCESS CARTRIDGE

CROSS-REFERENCE TO RELATED APPLICATIONS

This application claims priority to Japanese Patent Application No. 2003-054098 filed in the Japanese Patent Office on Feb. 28, 2003, and Japanese Patent Application No. 2004-009527 filed in the Japanese Patent Office on Jan. 16, 2004, the disclosures of which are incorporated herein by reference in their entirety.

BACKGROUND OF THE INVENTION

1. Field of the Invention

The present invention relates to a process cartridge detachably attached to an image forming apparatus, and more particularly to a process cartridge configured to accommodate an image carrier and at least one image forming process device.

2. Discussion of the Related Art

In an image forming apparatus such as a copying machine, a printer, a facsimile machine, or other similar devices, an electrostatic latent image formed on a photoreceptor functioning as an image carrier is developed with toner by a developing device to obtain a visual image, i.e., a toner image. Next, the toner image is transferred onto a recording medium such as a sheet in a transfer process.

With regard to the transfer process, in the case of single color image formation, a toner image may be directly transferred from a photoreceptor to a sheet. In the case of multi-color image formation, toner images of different colors formed on respective photoreceptors may be sequentially transferred onto a sheet while being superimposed upon each other on the sheet. Alternatively, toner images of different colors formed on respective photoreceptors may be sequentially transferred onto an intermediate transfer element, i.e., a primary transfer, while being superimposed upon each other on the intermediate transfer element. Also, the multi-color image superimposed on the intermediate transfer element may be collectively transferred onto a sheet during a secondary transfer.

An image forming apparatus, in which a plurality of image forming devices, including photoreceptors, are arranged along an intermediate transfer element in the direction of movement of the intermediate transfer element, is called a tandem-type image forming apparatus. A tandem-type image forming apparatus is described in, for example, Published Japanese patent application No. 2002-14596:

As described in Published Japanese patent application No. 2002-14596, devices used for image formation, such as, a photoreceptor, a charging device, etc. (hereafter referred to as "image forming process devices"), are configured to be pulled out from an inserted position to a pulled-out position in the main body of an image forming apparatus for repair, maintenance check, or replacement with new ones at the end of their useful life.

Published Japanese patent application No. 2002-297002 describes a process cartridge which integrally accommodates image forming process devices. However, when the process cartridge is pulled out from and inserted into the main body of such a device for repair, maintenance check, or replacement, care must be exercised in order to avoid damaging the image forming process devices, especially, a photoreceptor, for example, by touch. Therefore, touching of the photoreceptor is prevented by covering it with a covering member, such as, a shutter. In addition, when removing the process cartridge from the main body of the image forming apparatus, the process cartridge is pulled out in the axial direction of the photoreceptor.

Published Japanese patent application No. 2002-196647 describes a process cartridge which is taken out from the main body of an image forming apparatus in a direction perpendicular to an axial direction of a photoreceptor. In these devices, if a process cartridge is inserted or removed from the image forming apparatus by moving it upward and downward, a space for removing the process cartridge is required. That is, sufficient space needs to be provided above an upper portion of the image forming apparatus. Recently, demands for reducing the size of image forming apparatuses continue to increase. In the case of a relatively small image forming apparatus, space may be easily provided at a region around an upper portion thereof. However, in the case of a relatively large image forming apparatus of the type generally used in an office and capable of producing a large number of prints or copies, it may be difficult to provide sufficient space anywhere in the image forming apparatus.

Therefore, it is desirable to provide a process cartridge that can be easily inserted and removed from the main body of an image forming apparatus without damaging any of the image forming process devices assembled in the process cartridge and without, at the same time, increasing the cost of the process cartridge. Further, it is desirable to provide an image forming apparatus with enhanced operability to insert and remove such a process cartridge from its main body.

SUMMARY OF THE INVENTION

According to an aspect of the present invention, a process cartridge detachably attached to an image forming apparatus includes an image carrier configured to carry an image, at least one image forming process device configured to form images, a case configured to integrally accommodate the image carrier and the at least one image forming process device, and a first non-slip holding portion provided on a partial surface of the case. The process cartridge is configured to move in a direction substantially parallel to a longitudinal direction of the image carrier. When the process cartridge is attached to and detached from the image forming apparatus, an operator holds the process cartridge by grasping the first non-slip holding portion and a rear surface of a part of the case located on a side opposite from the first non-slip holding portion.

According to another aspect of the present invention, an image forming apparatus includes an image carrier, at least one image forming process device, and a process cartridge detachably attached to the image forming apparatus. The process cartridge includes a case configured to integrally accommodate the image carrier and the least one image forming process device, and a first non-slip holding portion provided on a partial surface of the case. The process cartridge is configured to move in a direction substantially parallel to a longitudinal direction of the image carrier. When the process cartridge is attached to and detached from the image forming apparatus, an operator holds the process cartridge by grasping the first non-slip holding portion and a rear surface of a part of the case located on a side opposite from the first non-slip holding portion.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
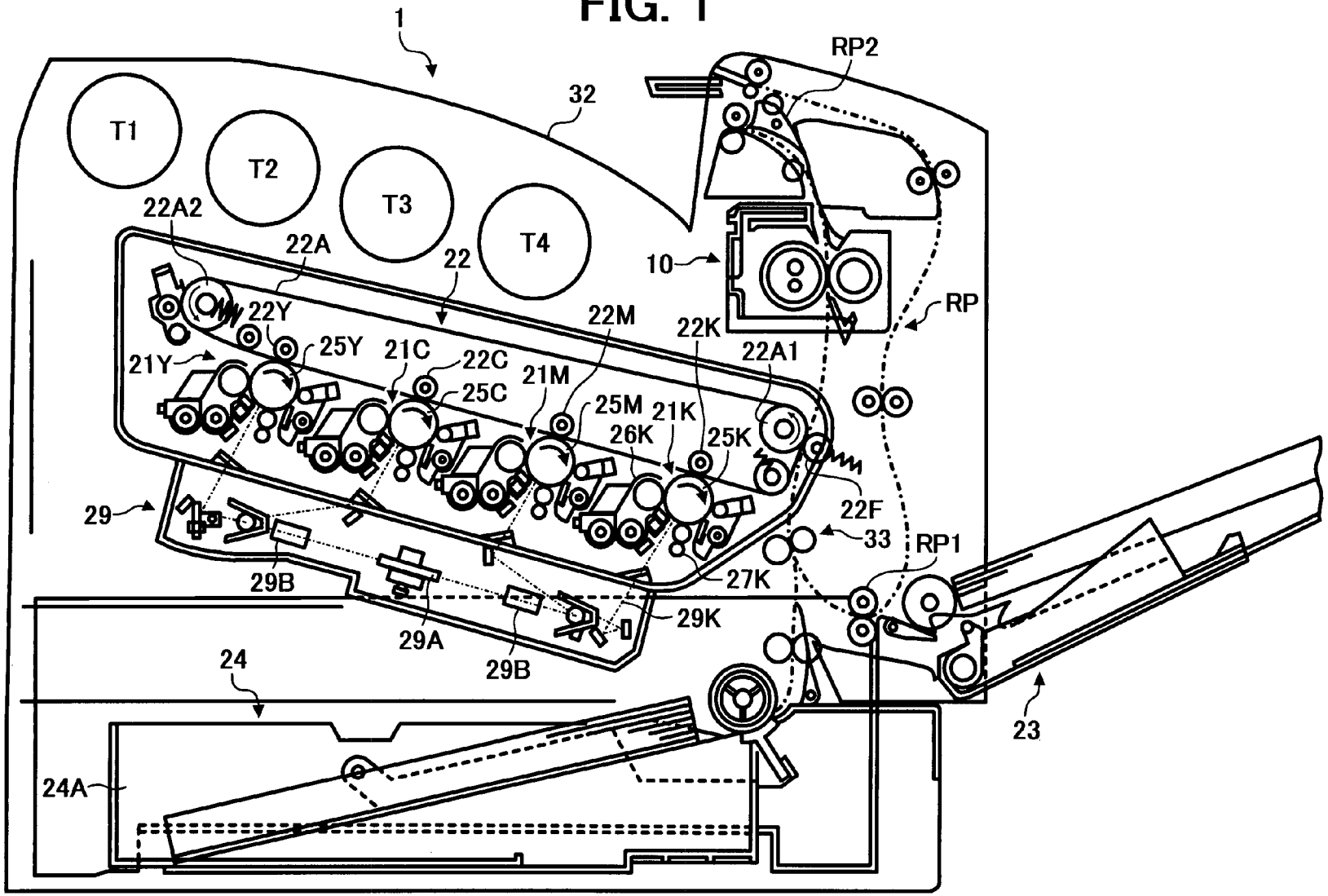
FIG. 1 is a schematic view of an image forming apparatus including process cartridges according to an embodiment of the present invention.

Preferred embodiments of the present invention are described in detail referring to the drawings, wherein like reference numerals designate identical or corresponding parts throughout the several views.

FIG. 1 is a schematic view of an image forming apparatus including process cartridges according to an embodiment of the present invention. Examples of the image forming apparatus illustrated in FIG. 1 include a multi-color, tandem-type printer. In addition to printers, copying and facsimile machines incorporating an image forming process in a manner similar to printers are also considered image forming apparatuses in the context of this invention. Further, the image forming apparatus may form single-color images instead of multi-color images.

Referring to FIG. 1, an image forming apparatus 1 includes: image forming devices 21Y, 21C, 21M, and 21K that form respective color toner images corresponding to a multi-color image of an original document; transfer devices 22 arranged opposite to the image forming devices 21Y, 21C, 21M, and 21K; and sheet feeding devices, such as, a manual sheet feeding tray 23 and/or a sheet feeding device 24 and cassette 24A, that feed a recording sheet to a transfer station between the respective image forming devices 21Y, 21C, 21M, and 21K and the transfer devices 22. The image forming apparatus 1 further includes registration rollers 33, which assist to transfer recording sheets fed from the sheet feeding devices first to an image transfer station at an image forming time, and then to a fixing device 10, which fixes the transferred color toner image onto the recording sheet.

The fixing device 10 uses a heat roller fixing method, in which the transferred color toner image is fused and fixed onto the recording sheet by the action of heat and pressure of a heat roller and a pressure roller. The heat and pressure rollers face and contact each other via at a point on a sheet conveying path.

The transfer devices 22 include a transfer belt 22A spanning a plurality of rollers, including a drive roller 22A1 and a driven roller 22A2, and transfer bias applying devices 22Y, 22C, 22M, and 22K that apply a transfer bias to the transfer belt 22A at respective positions opposite to the photoconductive drums 25Y, 25C, 25M, and 25K in the image forming devices 21Y, 21C, 21M, and 21K via the transfer belt 22A. Toner images of respective colors are sequentially and electrostatically transferred and superimposed on each other from the photoconductive drums 25Y, 25C, 25M, and 25K to the transfer belt 22A, by applying a transfer bias having a polarity opposite to that of the color toner by the respective transfer bias applying devices 22Y, 22C, 22M, and 22K. The transfer devices 22 further include a secondary transfer bias applying device 22F disposed on the conveying path of the recording sheet to transfer the superimposed color toner image from the transfer belt 22A onto the recording sheet.

The image forming apparatus 1 uses various types of recording sheets such as a plain paper generally used in a copying machine, or a special sheet having a thermal capacity larger than plain paper, such as, for example, an overhead transparency film sheet, a card, a postcard, a thick paper having a specific weight of about 100 $g/m^2$ or greater, or an envelope.

In the image forming apparatus 1 of FIG. 1, the image forming devices 21Y, 21C, 21M, and 21K form yellow, cyan, magenta, and black toner images, respectively, and their configurations are substantially the same except for the color of their toner. For this reason, only the configuration of the image forming device 21K will be described hereinafter.

The image forming device 21K includes a drum-shaped photoreceptor 25K (hereafter referred to as a "photoconductive drum 25K") serving as an image carrier. Arranged around the photoconductive drum 25K in a clockwise direction, or the direction of rotation of the photoconductive drum as indicated in FIG. 1, are a charging device 27K, a developing device 26K, and a cleaning device 28K (shown in FIG. 2). In this embodiment, the charging device 27K, the developing device 26K, and the cleaning device 28K may be referred to as image forming process devices that perform image forming processes. An image writing device 29 exposes the surface of the photoconductive drum 25K located between the charging device 27K and the developing device 26K with an image writing light 29K to form an electrostatic latent image in accordance with image information corresponding to the multi-color image of an original document. As an alternative image carrier, a belt-shaped photoreceptor may be employed instead of the photoconductive drum 25K.

Figure 2:
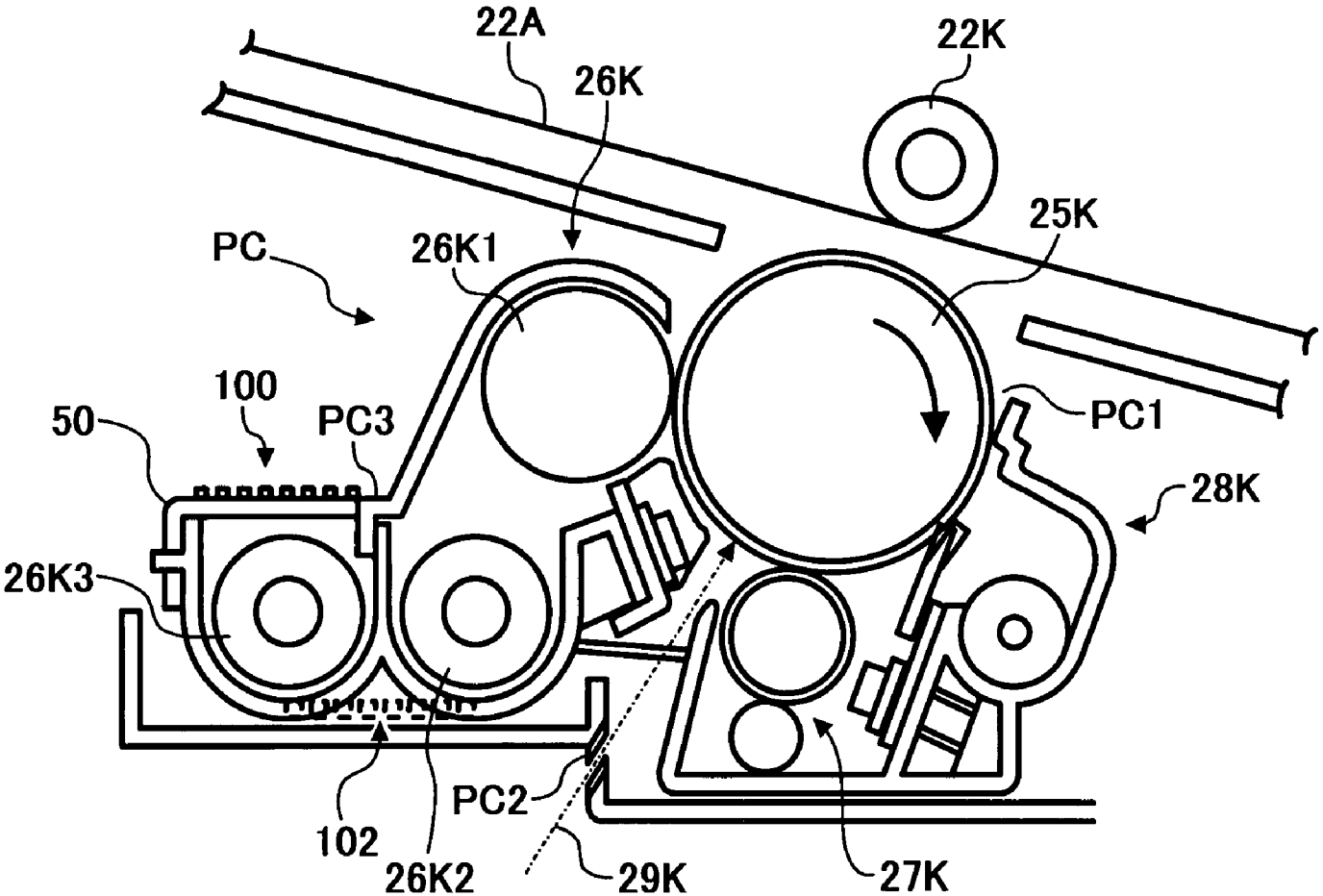
FIG. 2 is a schematic view of a process cartridge for forming a black image according to an embodiment of the present invention.

In this embodiment, as illustrated in FIG. 2, the photoconductive drum 25K, and the image forming process devices, including the charging device 27K, the developing device 26K, and the cleaning device 28K, are integrally assembled in a process cartridge. Alternatively, the photoconductive drum 25K and at least one of the image forming process devices may be integrally assembled in the process cartridge.

In the image forming apparatus 1, as illustrated in FIG. 1, the transfer device 22 is slanted downwardly, reducing its horizontal dimension and thereby consequentially reducing the overall size of the image forming apparatus 1.

The image forming apparatus 1 performs image forming operations based on processes and conditions in the following manner. A description will be given of an image forming operation of the image forming device 21K using black toner as being representative. Image forming operations are performed in the image forming devices 21Y, 21C, and 21M in a manner similar to the image forming device 21K.

Upon starting an image forming cycle, the photoconductive drum 25K is driven to rotate by a main motor (not shown) and an AC bias, or a voltage signal without a DC component, is applied thereto from the charging device 27K, thereby setting the surface potential of the photoconductive drum 25K to a reference potential, e.g., approximately −50V.

Subsequently, the photoconductive drum 25K is uniformly charged with a voltage signal having a DC component superimposed to an AC bias by the charging device 27K to a potential substantially equal to the DC component, thereby setting the surface potential of the photoconductive drum 25K to a potential determined by a process control section ranging from approximately −500V to −700V, for example.

Once the photoconductive drum 25K is uniformly charged, an image writing process begins, wherein the image writing device 29 exposes the surface of the photoconductive drum 25K with the image writing light 29K to form an electrostatic latent image in accordance with digital image information sent from a controller (not shown). The image writing light 29K, emitted from a laser light source in accordance with digitized light emitting signals for each color corresponding to the digital image information, passes through a cylinder lens (not shown), a polygonal mirror 29A, f-theta lenses 29B, through third mirrors (not shown), and a long toroidal (WTL) lens (not shown) toward the surface of the photoconductive drum 25K, thereby forming the electrostatic latent image on the surface of the photoconductive drum 25K. The surface potential of the exposed portion of the photoconductive drum 25K is approximately −50V.

The electrostatic latent image formed on the photoconductive drum 25K is developed with black toner by the developing device 26K. In the development process, a DC bias in a range from −300V to −500V with an AC bias superimposed thereupon is applied to a developing sleeve (not shown) of the developing device 26K. An image portion where the potential is attenuated by the irradiation of the image writing light 29K is developed with black toner (toner charging amount: −20 to −30 μC/g), thereby forming a black toner image on the photoconductive drum 25K.

After the development process, toner images of respective colors are sequentially and electrostatically transferred from the photoconductive drums 25Y, 25C, 25M, and 25K onto the transfer belt 22A by applying a transfer bias having a polarity opposite to that of the color toner to the transfer belt 22A by the respective transfer bias applying devices 22Y, 22C, 22M, and 22K. The superimposed color toner image is then transferred from the transfer belt 22A onto the recording sheet by applying a transfer bias to the transfer belt 22A by the secondary transfer bias applying device 22F. The recording sheet is fed out from the registration rollers 33 at an appropriate time in the transfer process.

The recording sheet passing the transfer position for the superimposed color toner image is separated from the transfer belt 22A at the drive roller 22A1 that drives the transfer belt 22A to rotate. Then, the recording sheet is conveyed to the fixing device 10. In the fixing device 10, the transferred color toner image is fixed onto the recording sheet while the recording sheet passes through a fixing nip part formed between a heat roller and a pressure roller. After the fixing process in a single sided image forming mode, the recording sheet is discharged to a sheet discharging tray 32.

The image forming apparatus 1 has a configuration that allows images to be formed on two sides (the first and second sides) of the recording sheet. When a dual side image forming mode is selected, the recording sheet passed through the fixing device 10 is reversed in a reversing/circulating path (RP) and fed toward the registration rollers 33 by sheet feeding rollers RP1, which is also configured to feed a recording sheet from the manual sheet feeding tray 23. Subsequently, the recording sheet is again conveyed to the transfer position from the registration rollers 33. A switch pick RP2, which is disposed above the fixing device 10, is configured to switch a conveying path of the recording sheet between the single side and the dual side image forming modes.

Reference characters T1, T2, T3, and T4 in FIG. 1 indicate toner supplying containers that supply toners of different colors to the developing devices.

The values of the charging and developing potentials in the above-described embodiment are given as non-limiting examples.

FIG. 2 is a schematic view of the process cartridge for forming a black image. The process cartridge is formed from a case 50 made of resin. As shown in FIG. 2, the case 50 includes two openings PC1 and PC2. The opening PC1 is formed in a wall portion of the case 50 facing the transfer belt 22A. A part of the photoconductive drum 25K is exposed to the outside through the opening PC1. The opening PC2 is formed in a wall portion of the case 50 facing the image writing device 29. The image writing light 29K is emitted from the image writing device 29 toward the surface of the photoconductive drum 25K through the opening PC2.

The process cartridge is attached to and detached from the image forming apparatus 1 by moving the process cartridge in an axial direction (i.e., a longitudinal direction) of the photoconductive drum 25K. In other words, the process cartridge is moved in a direction perpendicular to the surface of FIG. 2 between an inserted position, where the process cartridge is inserted into the image forming apparatus 1, and a pulled-out position, where the process cartridge is pulled-out from the image forming apparatus 1 for repair, maintenance checks, or replacement at the end of its useful life.

Figure 3:
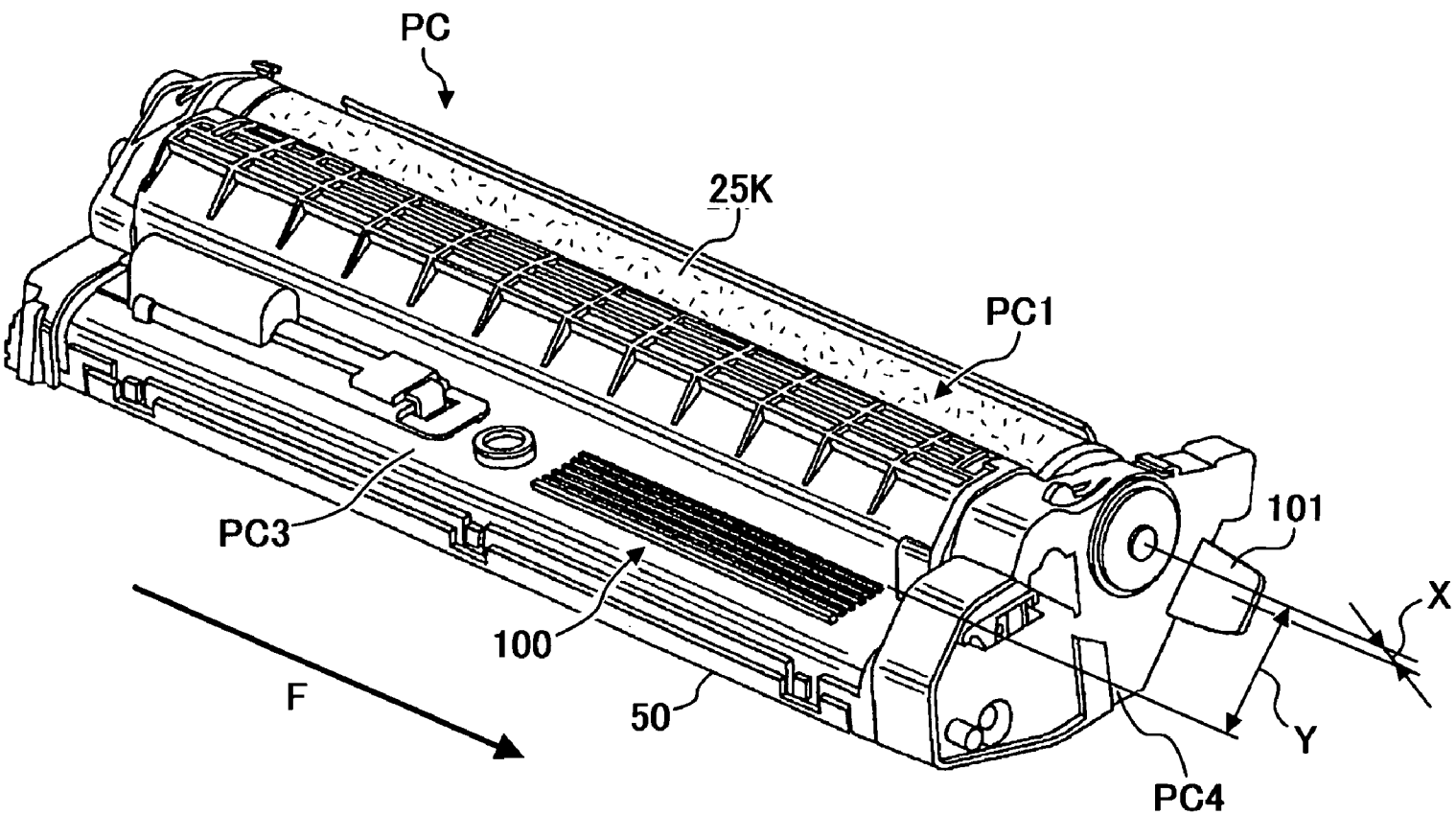
FIG. 3 is a perspective view of the process cartridge seen from above.

FIG. 3 is a perspective view of the process cartridge seen from above. As shown in FIG. 3, the process cartridge includes a non-slip holding portion 100 (hereafter referred to as a "holding portion 100") on a partial surface of the case 50. Specifically, as shown in FIGS. 2 and 3, the holding portion 100 is provided on a portion of an upper surface PC3 of the case 50 generally directed in parallel to the exposed surface of the photoconductive drum 25K near the developing device 26K. The holding portion 100 is formed by carving the upper surface PC3 of the case 50 into a concavo-convex shape.

When the process cartridge is attached to and detached from the image forming apparatus 1, an operator holds the process cartridge by grasping the holding portion 100 and an opposed bottom surface of the case 50. The holding portion 100 is configured to prevent slip during installation, removal, and handling of the process cartridge by the operator.

Further, the holding portion 100 is provided on the upper surface PC3 of the case 50 which is in a stepped relationship relative to the exposed surface of the photoconductive drum 25K. As shown in FIG. 2, the developing device 26K includes a developing sleeve 26K1, a developer supplying roller 26K2 that supplies developer to the developing sleeve 26K1, and a developer agitating roller 26K3 disposed adjacent to the developer supplying roller 26K2. The developing device 26K is disposed facing an exposed surface of the photoconductive drum 25K. With this layout, the developer supplying roller 26K2 and the developer agitating roller 26K3 are disposed at a position lower than the developing sleeve 26K1 and, because the upper surface PC3 opposes the developer agitating roller 26K3, the upper surface PC3 is in a stepped relationship relative to the exposed surface of the photoconductive drum 25K, that is, the upper surface PC3 is located at a position lower than the exposed surface of the photoconductive drum 25K.

With the above-described structure, when handling the process cartridge, an operator can grasp the holding portion 100 without touching the exposed surface of the photoconductive drum 25K, while still being aware of it.

As shown in FIG. 3, the holding portion 100 is provided on a front side of the upper surface PC3 with respect to the direction in which the process cartridge is removed from the image forming apparatus as indicated by the arrow F in FIG. 3 (i.e., in the direction of movement of the process cartridge from the inserted position to the pulled-out position). Thus, when removing the process cartridge from the image forming apparatus 1, the operator can grasp the holding portion 100 before the entire area of the process cartridge in the axial direction of the photoconductive drum 25K is pulled out. With this structure, when pulling out the process cartridge, the operator can hold it at the beginning of the removal process, thereby stabilizing its behavior so that rattling can be prevented or significantly reduced. With such an advantageous design, the photoconductive drum 25K and the image forming process devices, including the charging device 27K, the developing device 26K, and the cleaning device 28K assembled in the process cartridge, are not exposed to the vibrations normally created when removing conventional process cartridges from prior art image forming devices.

As shown in FIG. 3, the process cartridge further includes a grip 101 that protrudes from a frontal vertical side wall PC4 of the process cartridge. As shown in FIG. 3, the shaft of the photoconductive drum 25K is supported by the side wall PC4 and the opposite side wall. The process cartridge is configured to be pulled out by gripping the grip 101 and pulling.

As described above, the holding portion 100 is provided on the upper surface PC3 of the process cartridge, while the grip 101 is provided on the side wall PC4 of the process cartridge. The holding portion 100 and the grip 101 are provided on the sides opposite to each other relative to a vertical plane containing the rotational axis of the photoconductive drum 25K. With this structure, when the process cartridge is detached from the image forming apparatus 1, the operator supports the process cartridge from its both sides. Therefore, the weight of the process cartridge supported by the operator is well-balanced. If the operator supports the process cartridge from its single side, the weight of the process cartridge is concentrated at one side, thereby increasing the weight that must be born by the operator.

When the process cartridge is removed from the image forming apparatus 1, first, the operator pulls it out initially by holding the grip 101, for example, by his or her right hand. Then, the operator grasps the holding portion 100 of the pulled-out process cartridge, for example, by his or her left hand. By doing so, the operator can safely and stably handle the process cartridge.

As described above, the holding portion 100 is provided on only a single side of the process cartridge relative to a vertical plane containing the rotational axis of the photoconductive drum 25K. If the operator holds the process cartridge by grasping only the holding portion 100 (not the grip 101), a moment is produced in the process cartridge about a supporting point where the operator grasps the holding portion 100. Even if such moment is produced in the process cartridge, the process cartridge will not slip from the operator's hand because the process cartridge is pulled-out in the axial direction of the photoconductive drum 25K, not in the slanting direction toward the holding portion 100 (i.e., not in the direction perpendicular to the axial direction of the photoconductive drum 25K) and because the process cartridge does not move toward the hand of the operator grasping the holding portion 100.

As shown in FIG. 3, in the process cartridge, the relationship X<Y is satisfied, where X is a distance between the grip 101 and the rotational center axis of the photoconductive drum 25K, and Y is a distance between the holding portion 100 and the rotational center axis of the photoconductive drum 25K. By satisfying this relationship, when the operator pulls out the process cartridge by holding the grip 101 and then by grasping the holding portion 100, the operator grasps the holding portion 100 which is away from the exposed surface of the photoconductive drum 25K. This structure prevents the operator from touching the exposed surface of the photoconductive drum 25K and eliminates the need, for example, to provide a shutter to cover the exposed surface of the photoconductive drum 25K. As a result, the occurrence of an abnormal image is prevented, which is caused by the touch of the exposed surface of the photoconductive drum 25K. Further, the hands of the operator are not stained accidentally by the exposed surface of the photoconductive drum 25K. Moreover, the cost for providing such a member to protect the exposed surface of the photoconductive drum is eliminated.

As described above, when the process cartridge is attached to and detached from the image forming apparatus 1, the process cartridge is moved along the axial direction of the photoconductive drum 25K. In the image forming apparatus 1, the process cartridge is not pulled out toward the upper side of the image forming apparatus 1, but toward the side of the image forming apparatus 1 where the operator stands at the time of image formation. With this configuration, the extra space used for attaching and detaching the process cartridge to and from the image forming apparatus 1 may be also reduced, especially around the upper side of the image forming apparatus 1, thereby additionally reducing the cost associated with providing the extra space around the upper side of the image forming apparatus. When the process cartridge is pulled out from the image forming apparatus 1 in the F direction by holding the grip 101, the holding portion 100, which is provided at the front side of the process cartridge as shown in FIG. 3, first appears. Then, the operator can hold the process cartridge by grasping the grip 101, the holding portion 100, and the bottom surface of the case 50 positioned on the opposite side (i.e., the rear side) from the holding portion 100. Because the operator holds the process cartridge with both hands, even though the weight of the process cartridge is unbalanced, the process cartridge can be smoothly and stably inserted into and pulled-out from the image forming apparatus 1 without a rattle.

As described above, the holding portion 100 is provided on the upper surface PC3 of the case 50, which is oriented in the same direction as the exposed surface of the photoconductive drum 25K. Because the holding portion 100 is away from the exposed surface of the photoconductive drum 25K, the operator does not touch the photoconductive drum 25K when grasping the holding portion 100. Further, because the operator is able to see the exposed surface of the photoconductive drum 25K, accidental touches of the exposed surface of the photoconductive drum 25K are significantly reduced or completely eliminated, thereby eliminating the need for a special structure to prevent the operator from touching the exposed surface of the photoconductive drum 25K.

In this embodiment, the non-slip holding portion 100 is formed on the upper surface PC3 so that the operator holds the process cartridge by grasping the holding portion 100 and the bottom surface of the case 50 positioned on an opposite side (i.e., a rear side) from the holding portion 100. In this structure, a construction part, such as, a grip, need not be provided to the process cartridge as the holding portion. Therefore, the structure of the process cartridge can be simplified, and the holding portion can be designed with numerous layouts in order to avoid the unbalanced weight previously described. Thus, operability of the process cartridge can be enhanced, and the cost of the process cartridge can be decreased.

Further, in this embodiment, when the process cartridge is inserted into and pulled-out from the image forming apparatus, the operator holds the process cartridge without inserting his or her hands into the process cartridge, preventing accidental and unnecessary touching of photoconductive drums of image forming process devices, such as, developing devices, charging devices, etc., thereby preventing damage to, and extending the useful life of, and improving the quality of these image forming devices.

Figure 4:
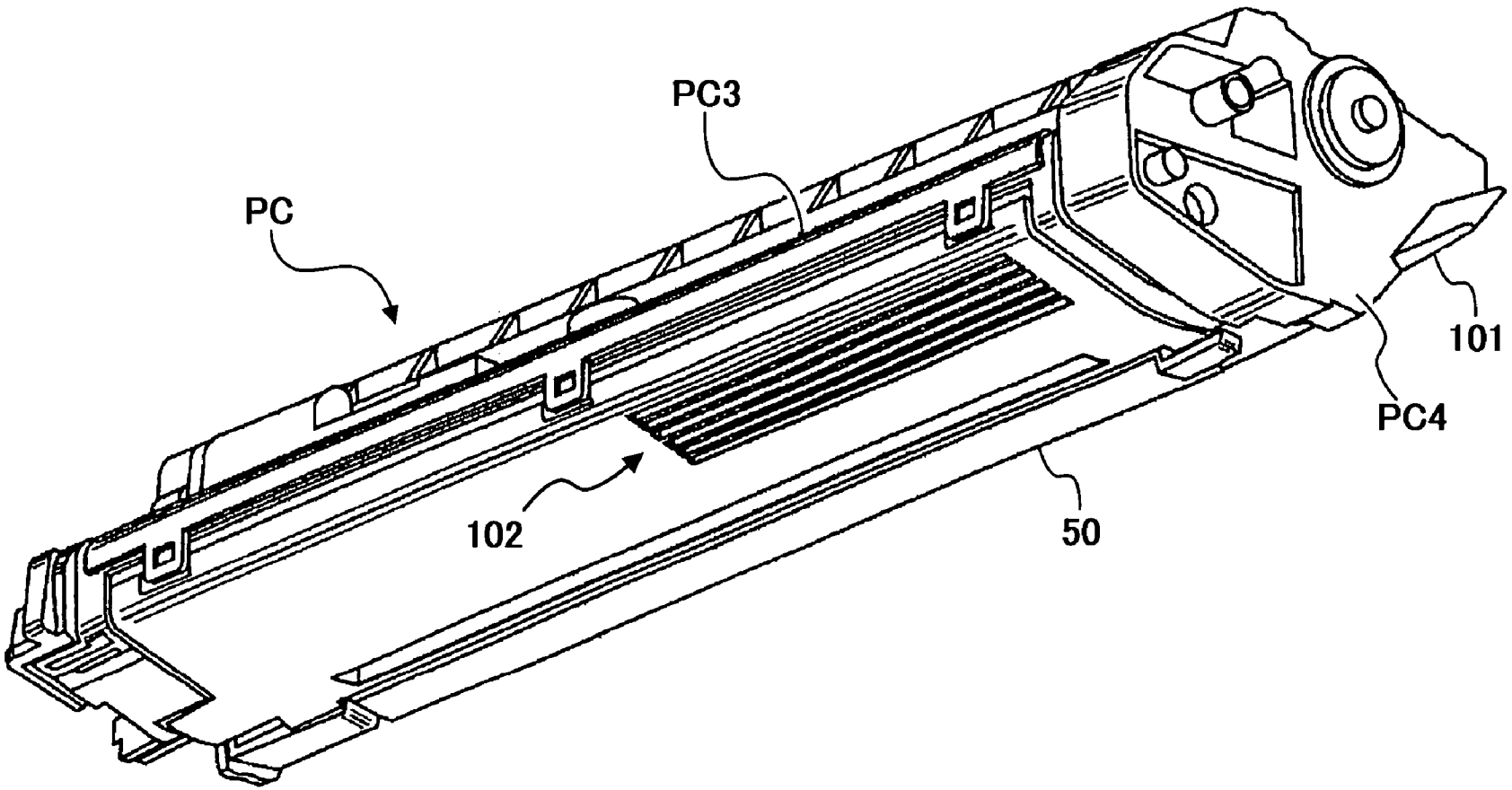
FIG. 4 is a perspective view of the process cartridge seen from below.

In this embodiment, the bottom surface of the case 50 of the process cartridge positioned on an opposite side (i.e., a rear side) from the holding portion 100 is configured to have a function similar to that of the holding portion 100. FIG. 4 is a perspective view of the process cartridge seen from below. As illustrated in FIG. 4, a non-slip portion 102 is provided on the bottom surface of the case 50 of the process cartridge positioned on an opposite side (i.e., a rear side) from the holding portion 100. The non-slip portion 102 is formed by carving the bottom surface of the case 50 into a concavo-convex shape. With the non-slip portion 102, the operator holds the process cartridge by grasping the holding portion 100 and the non-slip portion 102, thereby effectively preventing the process cartridge from slipping from his or her hands.

Even if the grasping force of the operator is small, his fingers can easily catch the process cartridge by the holding portion 100 and the non-slip portion 102. For example, the operator often does not know how large of a force is necessary when holding the process cartridge for pulling it out. However, in this embodiment, the process cartridge can be prevented from slipping off the hands of the operator without using an excess grasping force, so that the effort of the operator can be reduced.

In the process cartridge according to the embodiment of the present invention, the holding portion 100 and the non-slip portion 102 are formed by carving the surface of the case 50 of the process cartridge to function as non-slip members. Alternatively, the holding portion 100 and the non-slip portion 102 may be formed by attaching a tape or a rubber having a high coefficient of friction to the surface of the case 50.

The holding portion 100 may also function as an indicating portion which designates the position where the operator grasps the process cartridge. In this case, the holding portion 100 may be colored or displayed by characters. By doing so, the operator can easily recognize the holding portion 100, so that a careless touch on an exposed surface of a photoconductive drum can be reduced. Further, the holding portion 100 may be formed by carving the surface of the case 50 not only in a linear shape, but also in a curved line or character shape.

The shape of the grip 101 is not limited to that shown in FIG. 3. For example, a hole for catching the finger of the operator may be formed in the protruded piece-shaped grip 101.

Figure 5:
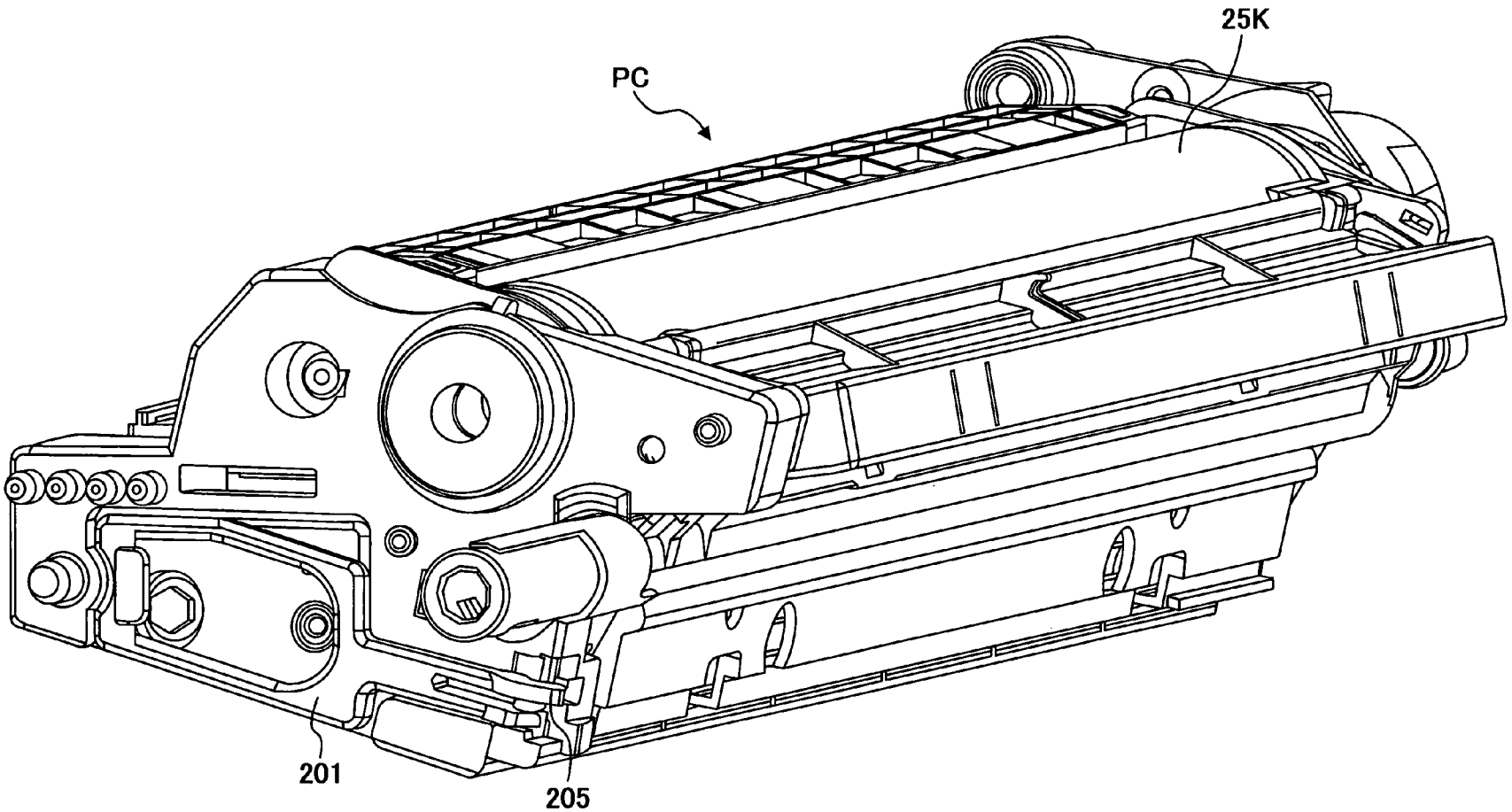
FIG. 5 is a perspective view of a process cartridge according to another embodiment of the present invention in which a handle is located at a retracted position.
Figure 6:
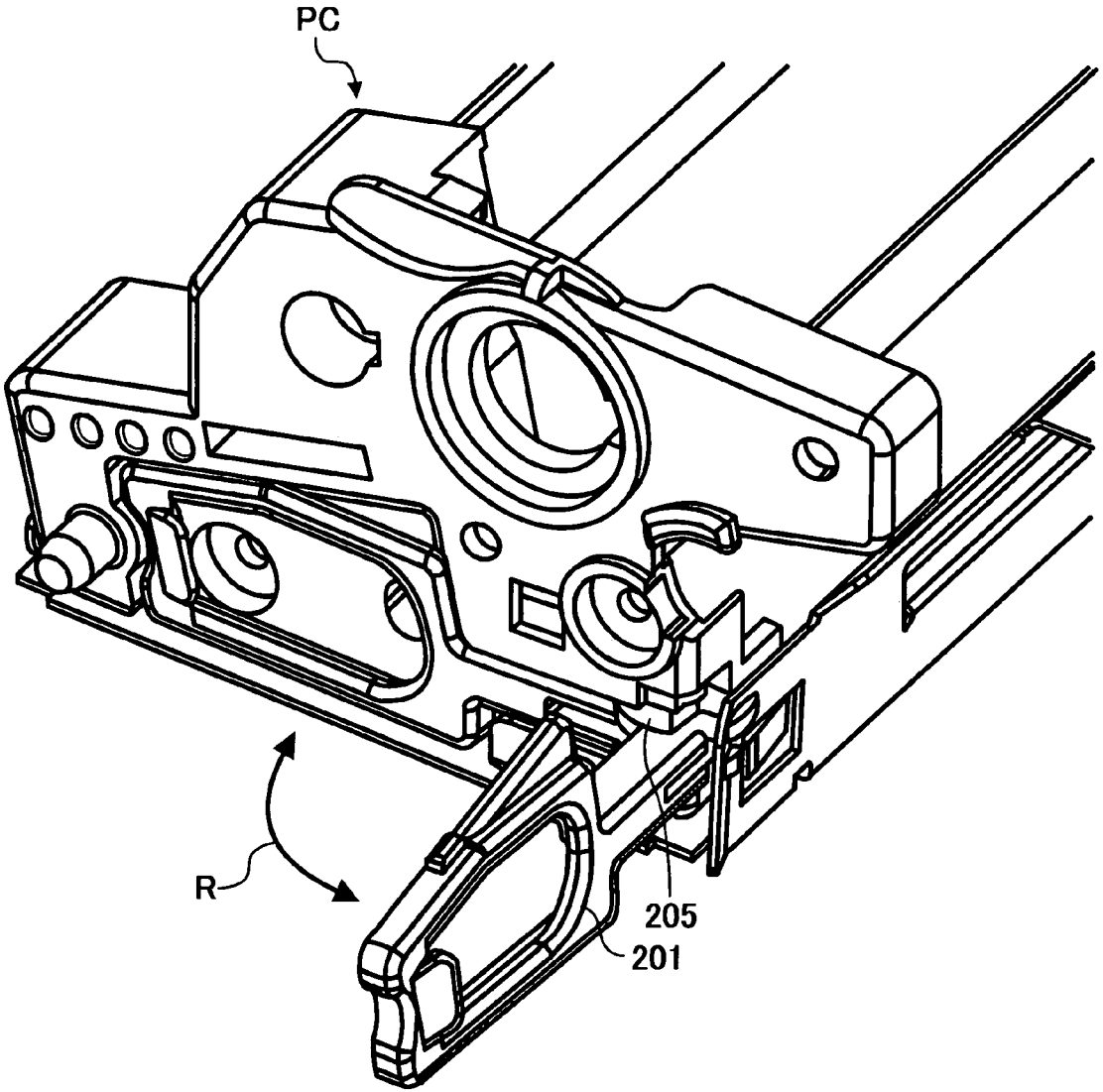
FIG. 6 is a perspective view of the process cartridge of FIG. 5 in which the handle is located at a protruded position.

FIGS. 5 and 6 are perspective views of a process cartridge according to another embodiment of the present invention. In this embodiment, the process cartridge includes a grip 201 instead of the grip 101 shown in FIG. 3. The grip 201 is configured to be rotated about a rotation shaft 205 between a retracted position (shown in FIG. 5) and a protruded position (shown in FIG. 6) in the direction indicated by double-headed arrow R in FIG. 6. Specifically, when the grip 201 is located at the retracted position, the grip 201 does not protrude forward in the pulling-out direction (i.e., the direction of movement) of the process cartridge as shown in FIG. 5. When the grip 201 is located at the protruded position, the grip 201 protrudes forward in the moving direction (i.e., the pulling out direction) of the process cartridge as shown in FIG. 6. The operator pulls out the process cartridge by rotating the hollow grip 201 from the retracted position to the protruded position and by grasping the hollow grip 201. The grip 201 is formed in a hollow shape.

According to the embodiments of the present invention, the process cartridge can be smoothly inserted into and pulled out from the image forming apparatus 1 without damaging the photoconductive drum and the image forming process devices. Thus, an occurrence of deteriorated image caused by damaging the exposed surface of the photoconductive drum can be prevented.

The present invention has been described with respect to the exemplary embodiments illustrated in the figures. However, the present invention is not limited to these embodiments and may be practiced otherwise.

Numerous additional modifications and variations of the present invention are possible in light of the above teachings. It is therefore understood that within the scope of the appended claims, the present invention may be practiced other than as specifically described herein.

What is claimed:

1. A process cartridge detachably attached to an image forming apparatus, comprising:

an image carrier configured to carry an image;

at least one image forming process device configured to perform image forming processes;

a case configured to integrally accommodate the image carrier and the at least one image forming process device; and a first non-slip holding portion provided on a surface of the case, wherein the process cartridge is configured to move in a longitudinal direction of the image carrier, and insertion or removal of the process cartridge from the image forming apparatus in the longitudinal direction is facilitated by grasping the process cartridge by the first non-slip holding portion and a rear surface of the case opposite from the first non-slip holding portion during which a portion of the case contacts a support of the image forming apparatus.

2. The process cartridge according to claim 1, further comprising:

a second non-slip holding portion provided on the rear surface of the case, wherein insertion or removal of the process cartridge from the image forming apparatus is facilitated by grasping the process cartridge by the first and the second non-slip holding portions.

3. The process cartridge according to claim 1, wherein the case further comprises an opening exposing at least a portion of the image carrier, and a surface of the case containing the first non-slip holding portion and a surface of the image carrier exposed through the opening are oriented substantially along a same direction.

4. The process cartridge according to claim 3, wherein the surface on which the first non-slip holding portion is at an elevation different than an elevation of the surface of the image carrier exposed through the opening.

5. The process cartridge according to claim 4, wherein the surface on which the first non-slip holding portion is provided is located at a position lower than the surface of the image carrier exposed through the opening.

6. The process cartridge according to claim 1, wherein the surface of the case containing the first non-slip holding portion is disposed on a front side of the case substantially oriented in a direction of movement of the process cartridge from an inserted position to a pulled-out position.

7. The process cartridge according to claim 6, wherein the first non-slip holding portion is disposed at a position opposite from a position of the image carrier relative to a center position of the case in a substantially horizontal direction of the case orthogonal to the direction of movement of the process cartridge.

8. The process cartridge according to claim 1, wherein the first non-slip holding portion is distinguished from a surface of the case other than the surface of the case on which the first non-slip holding portion is provided.

9. The process cartridge according to claim 8, wherein a frictional coefficient of the first non-slip holding portion is greater than a frictional coefficient of the surface of the case.

10. The process cartridge according to claim 9, wherein the first non-slip holding portion is formed by carving the surface of the case.

11. The process cartridge according to claim 9, wherein the first non-slip holding portion is formed by attaching a member to the surface of the case.

12. The process cartridge according to claim 1, wherein the at least one image forming process device comprises at least one of a developing device configured to develop the image carried by the image carrier, a charging device configured to charge a surface of the image carrier, and a cleaning device configured to clean the surface of the image carrier.

13. A process cartridge detachably attached to an image forming apparatus, comprising:

an image carrier configured to carry an image;

at least one image forming process device configured to perform image forming processes;

a case configured to integrally accommodate the image carrier and the at least one image forming process device; and a first non-slip holding portion provided on a surface of the case, wherein the process cartridge is configured to move in a direction substantially parallel to a longitudinal direction of the image carrier, and insertion or removal of the process cartridge from the image forming apparatus is facilitated by grasping the process cartridge by the first non-slip holding portion and a rear surface of the case opposite from the first non-slip holding portion.

wherein the surface of the case containing the first non-slip holding portion is disposed on a front side of the case substantially oriented in a direction of movement of the process cartridge from an inserted position to a pulled-out position, and wherein the cartridge further comprises a grip configured to be gripped when the process cartridge is moved between the inserted position and the pulled-out position, the grip being provided on a frontal wall surface of the case in the direction of movement of the process cartridge.

14. The process cartridge according to claim 13, wherein the image carrier is configured to rotate, and the first non-slip holding portion and the grip are provided on sides opposite to each other relative to a vertical plane containing a rotational axis of the image carrier.

15. The process cartridge according to claim 14, wherein a distance between the first non-slip holding portion and the rotational axis of the image carrier is greater than a distance between the grip and the rotational axis of the image carrier.

16. An image forming apparatus comprising:

an image carrier configured to carry an image;

image forming process devices configured to perform image forming processes;

a process cartridge detachably attached to the image forming apparatus, the process cartridge comprising:

a case configured to integrally accommodate the image carrier and at least one of the image forming process devices; and a first non-slip holding portion provided on a surface of the case, wherein the process cartridge is configured to move in a direction substantially parallel to a longitudinal direction of the image carrier, and insertion or removal of the process cartridge from the image forming apparatus is facilitated by grasping the process cartridge by the first non-slip holding portion and a rear surface of the case opposite from the first non-slip holding portion, wherein the surface of the case containing the first non-slip holding portion is disposed on a front side of the case substantially oriented in a direction of movement of the process cartridge from an inserted position to a pulled-out position, and wherein the process cartridge further comprises a grip configured to be gripped when the process cartridge is moved between the inserted position and the pulled-out position, the grip being provided on a frontal wall surface of the case in the direction of movement of the process cartridge.

17. The image forming apparatus according to claim 16, wherein the image carrier is configured to rotate, and the first non-slip holding portion and the grip are provided on the sides opposite to each other relative to a vertical plane containing a rotational axis of the image carrier.

18. The image forming apparatus according to claim 17, wherein a distance between the first non-slip holding portion and the rotational axis of the image carrier is greater than a distance between the grip and the rotational axis of the image carrier.

19. A process cartridge detachably attached to an image forming apparatus, comprising:

image carrying means for carrying an image;

image forming process means for performing image forming processes;

accommodating means for accommodating at least one of the image carrying means and the image forming process means; and a first non-slip holding means for facilitating handling the process cartridge, the first non-slip holding means being provided on a surface of the accommodating means, wherein the process cartridge is configured to move a longitudinal direction of the image carrying means, and insertion or removal of the process cartridge from the image forming apparatus in the longitudinal direction is facilitated by grasping the process cartridge by the first non-slip holding means and a rear surface of the accommodating means opposite from the first non-slip holding means during which a portion of the accommodating means contacts a support of the image forming apparatus.

20. The process cartridge according to claim 19, wherein the image forming process means comprises at least one of developing means for developing the image carried by the image carrying means, charging means for charging a surface of the image carrying means, and cleaning means for cleaning the surface of the image carrying means.

* * * * *